US008510667B2

(12) United States Patent
Maeder

(10) Patent No.: US 8,510,667 B2
(45) Date of Patent: Aug. 13, 2013

(54) AUTOMATED FLOODPLAIN ENCROACHMENT COMPUTATION

(75) Inventor: Christopher Edward Maeder, Verona, WI (US)

(73) Assignee: Autodesk, Inc., San Rafael, CA (US)

( * ) Notice: Subject to any disclaimer, the term of this patent is extended or adjusted under 35 U.S.C. 154(b) by 617 days.

(21) Appl. No.: 12/752,814

(22) Filed: Apr. 1, 2010

(65) Prior Publication Data

US 2011/0246935 A1 Oct. 6, 2011

(51) Int. Cl.
*G06F 3/048* (2006.01)
*G06F 3/01* (2006.01)

(52) U.S. Cl.
USPC ..... 715/765; 715/764; 715/780; 715/809; 715/810; 715/825

(58) Field of Classification Search
USPC ..... 715/809, 818, 823, 825, 851, 855, 715/764, 765, 780, 810
See application file for complete search history.

(56) References Cited

U.S. PATENT DOCUMENTS 5,794,178 A * 8/1998 Caid et al. ..... 704/9
6,101,496 A * 8/2000 Esposito ..... 701/532
6,658,356 B2 * 12/2003 Chen et al. ..... 702/5
6,678,615 B2 * 1/2004 Howard et al. ..... 702/5
7,031,959 B2 * 4/2006 Garner et al. ..... 1/1
7,039,640 B2 * 5/2006 Miller et al. ..... 1/1
7,085,650 B2 * 8/2006 Anderson ..... 702/2
7,353,113 B2 * 4/2008 Sprague et al. ..... 702/2
7,797,143 B2 * 9/2010 Belcher et al. ..... 703/9
7,917,292 B1 * 3/2011 Du ..... 702/5
2004/0078143 A1 * 4/2004 Howard et al. ..... 702/5
2004/0138817 A1 * 7/2004 Zoken et al. ..... 702/5
2006/0122794 A1 * 6/2006 Sprague et al. ..... 702/32
2006/0125828 A1 * 6/2006 Harrison et al. ..... 345/441
2008/0195362 A1 * 8/2008 Belcher et al. ..... 703/2

OTHER PUBLICATIONS

Wikipedia article, 100-year flood, http://en.wikipedia.org/wiki/100-year_flood, last modified Mar. 1, 2010, four pages.
Federal Emergency Management Agency memo dated Apr. 30, 2001, Subject: Policy for Use of HEC-RAS in the NFIP, two pages.
Federal Emergency Management Agency, A Guide for Obtaining and Developing Base (100-Year) Flood Elevations, Apr. 1995, 151 pages.

(Continued)

*Primary Examiner* — Nicholas Augustine
(74) *Attorney, Agent, or Firm* — Gates & Cooper LLP

(57) ABSTRACT

A method, apparatus, and article of manufacture provide the ability to define a floodplain encroachment. River reach and station information are received into a geographic information system (GIS). Floodplain encroachment values are defined using a graphical user interface (GUI). The GUI provides a simultaneous view of station identifiers for each station for which the floodplain encroachment is to be defined, profiles defined for each of the station identifiers, a method identification corresponding to each of the defined profiles, and a target water surface elevation change for each profile. The values are provided to a HEC-RAS engine which outputs analysis results that are simultaneously displayed in the GUI with the other information. The analysis results include a water surface elevation change, a top width, and a velocity for each profile-station pair. Users can modify the values and dynamically view the results from HEC-RAS in the GUI.

18 Claims, 11 Drawing Sheets

(56) References Cited

OTHER PUBLICATIONS

Federal Emergency Management Agency Floodplain Modeling Manual, Apr. 2002, 78 pages.
Federal Emergency Management Agency Floodplain Management Requirements. A Study Guide and Desk Reference for Local Officials. Unit 3: NFIP Flood Studies and Maps 3-1-3-19 and Appendix D: Glossary D-1-D12, Aug. 11, 2010, 57 pages.
HEC-RAS River Analysis System, Applications Guide, Version 3.1, Example 6, Floodway Determination, Nov. 2002, nine pages.
HEC-RAS River Analysis System, Hydraulic Reference Manual, Version 3.1, Chapter 9, Floodplain Encroachment Calculations, Nov. 2002, 39 pages.
HEC-RAS River Analysis System, User's Manual, Version 3.1, Chapter 10, Performing a Floodplain Encroachment Analysis and Appendix B, HEC-RAS Import/Export Files for Geospatial Data, Nov. 2002, 49 pages.
Floodway Encroachments, Floodplain Facts #12, Prepared by Southern Tier Central Regional Planning and Development Board, Aug. 11, 2009, three pages.

* cited by examiner

Encroachments

☒ Equal Conveyance Reduction

Left bank offset: 10 Right bank offset: 10

302

312 River: Beaver Creek Profile: PF#2

314 Reach: Kentwood Import to Method 1

Set Range of Values

316 Upstream RS: 5.99 Method none 306

318 Downstream RS: 5.0 Value 1 308

320 Set Selected Range Value 2 310

304

| | River Sta | Method | Value 1 | Value 2 |
|---|---|---|---|---|
| 1 | 5.99 | 5 | 1 | 1.2 |
| 2 | 5.875* | 5 | 1 | 1.2 |
| 3 | 5.76 | 5 | 1 | 1.2 |
| 4 | 5.685* | 5 | 1 | 1.2 |
| 5 | 5.61 | 5 | 1 | 1.2 |
| 6 | 5.49* | 5 | 1 | 1.2 |
| 7 | 5.41 | 5 | 1 | 1.2 |
| 8 | 5.4 BR | | | |
| 9 | 5.39 | 5 | 1 | 1.2 |
| 10 | 5.24* | 5 | 1 | 1.2 |
| 11 | 5.13 | 5 | 1 | 1.2 |
| 12 | 5.065* | 5 | 1 | 1.2 |
| 13 | 5.0 | 5 | 1 | 1.2 |

322

OK Cancel Clear Profile Clear All Profiles

FIG. 3
(PRIOR ART)

Profile Output Table - Encroachment 1

File Options Std. Tables User Tables Locations Help

HEC-RAS Plan: M5 River: Beaver Creek Reach: Kentwood | Reload Data

| Reach | River Sta | Profile | W.S. Elev | Prof Delta WS | E.G. Elev | Top Wdth Act | Q Left | Q Channel | Q Right |
|---|---|---|---|---|---|---|---|---|---|
| | | | (ft) | (ft) | (ft) | (ft) | (cfs) | (cfs) | (cfs) |
| Kentwood | 5.99 | PF#1 | 220.00 | | 220.30 | 1862.61 | 8127.94 | 4773.12 | 1098.94 |
| Kentwood | 5.99 | PF#2 | 221.07 | 1.07 | 221.35 | 1024.90 | 8364.84 | 5051.77 | 583.39 |
| | | | | | | | | | |
| Kentwood | 5.875* | PF#1 | 218.99 | | 219.27 | 1797.55 | 4442.85 | 6375.44 | 3181.70 |
| Kentwood | 5.875* | PF#2 | 219.99 | 1.00 | 220.41 | 880.81 | 3622.24 | 7985.90 | 2391.87 |
| | | | | | | | | | |
| Kentwood | 5.76 | PF#1 | 218.46 | | 218.61 | 1765.32 | 1824.33 | 6651.05 | 5524.62 |
| Kentwood | 5.76 | PF#2 | 218.96 | 0.50 | 219.42 | 675.92 | 62.08 | 10358.00 | 3579.92 |
| | | | | | | | | | |
| Kentwood | 5.685* | PF#1 | 218.23 | | 218.34 | 1873.27 | 3364.01 | 4723.59 | 5912.40 |
| Kentwood | 5.685* | PF#2 | 218.56 | 0.33 | 218.85 | 800.14 | 1767.86 | 6695.62 | 5536.52 |
| | | | | | | | | | |
| Kentwood | 5.61 | PF#1 | 218.09 | | 218.14 | 1988.71 | 5107.05 | 1408.46 | 7484.49 |
| Kentwood | 5.61 | PF#2 | 218.36 | 0.26 | 218.48 | 832.19 | 4428.15 | 1858.67 | 7713.17 |
| | | | | | | | | | |
| Kentwood | 5.49* | PF#1 | 217.90 | | 217.98 | 1910.08 | 4180.82 | 3241.47 | 6577.70 |
| Kentwood | 5.49* | PF#2 | 218.01 | 0.10 | 218.18 | 888.56 | 3150.53 | 4378.03 | 6471.44 |

502 504

FIG. 5
(PRIOR ART)

808 810 812 814 816 820 822 802 804 806

Floodplain Encroachments

| Reach | XS ID | Profile | Method | WSEL Rise | Left Encr Sta | Right Encr Sta | Delta WSEL | Top Width | Velocity |
|---|---|---|---|---|---|---|---|---|---|
| Kentwood | 5.76 | Profile 1 | | | | | | 1862.61 | 2.12 |
| Kentwood | 5.76 | Profile 2 | Method 1 | | 176.93 | 2101.84 | 0.98 | 1024.90 | 2.31 |
| Kentwood | 5.76 | Profile 4 | Method 1 | | 176.93 | 2101.84 | 0.98 | 1024.90 | 2.31 |
| Kentwood | 5.76 | Profile 4 | Method 1 | | 176.93 | 2101.74 | 0.98 | 1024.90 | 2.31 |
| Kentwood | 5.875 | Profile 1 | | | | | | 1797.55 | 1.98 |
| Kentwood | 5.875 | Profile 2 | Copy 4 to 1 | 0.85 | 344.69 | 1225.52 | 1.00 | 880.81 | 2.78 |
| Kentwood | 5.875 | Profile 3 | Method 4 | 1.05 | | | 1.07 | 776.75 | 3.13 |
| Kentwood | 5.875 | Profile 4 | Method 4 | 1.25 | | | 1.15 | 745.32 | 3.69 |
| Kentwood | 5.99 | Profile 1 | | | | | | 1765.32 | 1.54 |
| Kentwood | 5.99 | Profile 2 | Method 4 | 0.80 | | | 0.97 | 905.32 | 3.27 |
| Kentwood | 5.99 | Profile 3 | Method 4 | 1.05 | | | 1.08 | 843.27 | 4.56 |
| Kentwood | 5.99 | Profile 4 | Method 4 | 1.25 | | | 1.21 | 796.34 | 5.32 |
| Kentwood | 6.22 | Profile 1 | | | | | | 1988.71 | 1.51 |
| Kentwood | 6.22 | Profile 2 | None | | | | 0.67 | 1997.23 | 1.43 |
| Kentwood | 6.22 | Profile 3 | None | | | | 0.73 | 2001.13 | 1.41 |
| Kentwood | 6.22 | Profile 4 | None | | | | 0.84 | 2002.34 | 1.39 |
| Kentwood | 6.54 | Profile 1 | | | | | | 1910.08 | 1.47 |
| Kentwood | 6.54 | Profile 2 | None | | | | 0.43 | 1925.83 | 1.34 |
| Kentwood | 6.54 | Profile 3 | None | | | | 0.55 | 1934.67 | 1.31 |

Analyze Close Help 704 818

FIG. 8

AUTOMATED FLOODPLAIN ENCROACHMENT COMPUTATION

BACKGROUND OF THE INVENTION

1. Field of the Invention

The present invention relates generally to geospatial mapping systems, and in particular, to a method, apparatus, and article of manufacture for computing floodplain encroachments using a geospatial mapping system.

2. Description of the Related Art

A floodplain is a land area (usually adjacent to a stream or river) that is susceptible to being inundated (occasionally or periodically) by flood waters from any source. Due to the high value of land and structures built adjacent to a stream or river, it is desirable to maximize and develop in the floodplain area. A floodplain development that can obstruct flood flows, such as a fill/backfill, a bridge, or a building is referred to as an "encroachment". Various federal agencies require the purchase of flood insurance (in floodplain areas) and regulate new development for encroachments. As part of the analysis for encroachments, such federal agencies require the use of the HEC-RAS (Hydrologic Engineering Centers River Analysis System) program, developed by the United States Army Corps of Engineers, that provides a computer model used to conduct a hydraulic study, that produces flood elevations, velocities and floodplain widths. The use of the HEC-RAS system is time consuming, labor intensive, and therefore fails to provide an efficient mechanism for analyzing floodplains and encroachments. To better understand the problems of the prior art, a more detailed explanation of floodplains and HEC-RAS is useful.

Referring to FIG. 1, a floodplain 100 includes a floodway 102 and flood fringe 104. The floodway 102 is the channel of a river or other watercourse and adjacent areas the cover flood flows. In other words, the floodway 102 is the channel of a river or other watercourse and the adjacent land areas that must be reserved in order to discharge the base flood (see description below) without cumulatively increasing the water-surface elevation by more than a designated height. The flood fringe 104 is the portion of the floodplain 100 lying outside of the floodway 102 (i.e., areas that are covered by the flood but do not experience a strong current).

Generally, no new development is permitted within a floodway 102 unless a licensed professional demonstrates that the proposed encroachment will not result in a rise in the 100-year flood (also known as the base flood) elevation more than a designated height (usually 1 foot). The 100-year/base flood is a flood having a 1% chance of being equaled or exceeded in any given year. The base flood is used by the NFIP (national flood insurance program) as the basis for mapping, insurance rating, and regulating new construction. FEMA (Federal Emergency Management Agency) is the agency that is responsible for the NFIP field work (including floodplain maps) and community coordination.

As can be seen in FIG. 1, encroachments 106 may be constructed on the flood fringe 104. However, as stated above, FEMA will often not permit the constructions of any encroachment unless an engineer using HEC-RAS can verify that it will not increase the flood elevation of the base flood more than a designated height (e.g., 1 foot).

Currently, FEMA utilizes paper-based maps as part of the analysis and to obtain measurements. Calculations are performed based on the paper based maps, and data is entered into the HEC-RAS user interface. The HEC-RAS user interface utilizes a HEC-RAS engine to process the input data and outputs data that can be used to determine whether the encroachment with the specified input data is acceptable. However, the paper-based maps are not georeferenced, not current, and must be modernized. Accordingly, FEMA is in the process of modernizing the current floodplain maps over the next five (5) years where the paper-based maps are being converted to digital maps. In addition, numerous engineering flood studies are going to be performed to update inadequate and inaccurate previous studies upon which the paper maps are based.

The studies used to determine the floodmaps examine the areas through which floodwater will flow which requires a determination of ground elevations and obstructions to flow (such as vegetation, buildings, bridges, and other development) for these areas. Accurate data on the channel geometry and changes in the floodplain are obtained from ground surveys, aerial photography, or topographic maps. A cross section is a graphical depiction of the stream/river and the floodplain at a particular point along the stream/river. Cross sections are taken at right angles to the flow of the stream/river. At each cross section, the engineer has accurate information on the size and geometry of the channel, the shape of the floodplain, and the changes in the elevation of the ground. Accordingly, when calculating the stream channel through a floodway and the base flood measurements, engineers must perform various calculations and enter data for each cross section into the HEC-RAS system.

The prior art process for utilizing HEC-RAS often requires the manual construction of HEC-RAS input data, the manual determination and entry of cross section geometry data, and an iterative trial and error method for computing floodplain encroachments. Alternative methods may provide for a more automated method for extracting and entering cross-section geometry (e.g., by exporting and importing data from a GIS [geographic information system] mapping system/river mapping) but still require the manual entry of data into HEC-RAS along with an iterative trial and error method for computing the floodplain encroachments. Further, even the alternative partially-automated systems are not integrated with HEC-RAS thereby requiring users to restart their entire mapping process if an error or undesirable results are output from HEC-RAS. Further, due to the lack of integration, once complete, the user must export any final computations/values back to the GIS system.

FIGS. 2-5 illustrate the prior art technique used to define and calculate encroachments. FIG. 2 is a mock up display of a river 200 having various cross sections 3500, 4350, 5650, 6350, 7200, 8000, and 9200. As stated above, engineers must make various manual measurements and determinations to utilize the cross sections in an encroachment analysis. The dashed line indicates the deepest part of the river channel where the water flows. A builder may desire to build encroachments (e.g., by backfilling) on an area of the floodplain (e.g., on the right side near cross section 4350, or on the left side near cross section 7200. As an encroachment is built, the area where the water can flow is reduced thereby increasing the height of the flow up and/or down the river channel. Accordingly, one must examine the entire river flow to determine how and whether an encroachment will affect the floodplain. As stated above, in general, FEMA guidelines provide that encroachments cannot cause the height of the floodway to increase more than one foot.

As described above, the user must first manually construct the HEC-RAS input data, and manually determine and enter the cross section geometry data which is input into HEC-RAS. Thereafter, the HEC-RAS floodplain encroachment computation procedure is based on calculating a natural profile (existing conditions geometry) as the first profile in a multiple profile run. A profile (also known as a discharge profile) represents the profile/graph that specifies the amount of water that passes a point in a given period of time. Other profiles must then be run, to simulate and calculate the change in the height of the floodway based on various encroachment options, as desired. Accordingly, before performing an encroachment analysis, the user must develop an accurate model of the existing river system.

The user then selects a desired profile and attempts to set various values. To compute the floodplain encroachments, an engineer would first define floodplain encroachment station locations (i.e., the distances along a stream where computations are performed) for each cross section of the river 200 using a desired profile. FIG. 3 illustrates a dialog window used to define the floodplain encroachment station locations for a single profile 302 in the prior art. As illustrated, thirteen (13) river stations 304 are defined and for each station 304. The different stations 304 may also be selected by specifying the river and reach in areas 312-314. Once a reach is selected, the user can enter a starting and ending river station in fields 316-318.

The user is also required to select a profile number 302 to work on (i.e., to perform an encroachment analysis on). It may be noted that HEC-RAS requires that each of the encroachment analysis steps described herein must be performed under a single discharge profile 302 at a time. However, the encroachment analysis is not performed on profile one (1) because profile 1 is the base profile that is used for comparison.

The next step is to enter the desired encroachment method 306 to be used for the currently selected profile 302. Once a method 306 is selected, the data entry boxes 308-310 that correspond to the selected method 306 will display below the method selection box 306. For the method 306, HEC-RAS contains five optional methods 306 for specifying the floodplain encroachments. In method 1, the user enters right and left encroachment stations. The final mapping of encroachment stations is performed using method 1. In method 2, the user enters a fixed top width. In method 3, the user specifies the percent reduction in conveyance. In method 4, the user specifies a target water surface increase. Methods 1 and 4 are FEMA's preferred methods for defining encroachment stations. In method 5, the user specifies a target water surface increase and a maximum change in energy. In FIG. 3, method 5 has been specified for all of the stations 304. In FIG. 3, two value boxes 306-308 are displayed for the target water surface increase, and the maximum change in energy. By pressing the "set selected range" button 320, all of the stations and values will fill in the table 322. After the data has been put into the table 322, the user can manually change the method and corresponding data values directly from the table 322.

The station, profile and data entry process is repeated for all of the different profiles for which the user wants to perform the encroachment analysis. Once all the profiles and data has been entered, the user may select the "OK" button to proceed to the next step. Again, the user can only view one discharge profile 302 at a time and due to the manual entry required, it is very easy to make a mistake and overwrite a value that should not be overwritten.

The next step in the process is to perform the floodplain encroachment computational analysis based on the data entered using the interface of FIG. 3. FIG. 4 is the graphical user interface used to perform the computational analysis in the prior art. The user simply selects the "compute" button 402 to perform the analysis.

Once computed, the next step is to review the analysis results which may include a review of the increase in computed water surface elevation, a review of the change in floodway top width, and/or a review of the change in flow velocity. A different interface must be used to display such results. FIG. 5 is a graphical user interface used to display the results for the user to review in the prior art. As can be seen in FIG. 5, the change (i.e., the delta) in the water surface elevation is displayed in column 502. As at least one of the values in column 502 is over the one (1) foot mark (i.e., 1.07), the process may need to be repeated. The developer can further increase the encroachment at the water stations where the delta value is under one (1) foot. In addition, column 504 displays the top width that should be (based on FEMA guidelines) fairly uniform across all of the stations/cross sections.

However, note that the other area of concern is that of the velocity which is not displayed in the user interface of FIG. 5 of the prior art. With respect to velocity, it is desirable (and may be required) to maintain a velocity of under 6 ft/sec. Instead, the user must proceed to a different screen to view the velocity information. Accordingly, it is desirable to view all three items—the change in water surface elevation, the top width, and the velocity. Some prior art techniques may provide a single screen to allow the user to view the top width, water surface change, as well as the velocity in a single screen. However, such a display is in a separate graphical user interface and fails to show the user what encroachment definitions were used to obtain the results displayed. Instead, the user must manually recall such information from memory if desired.

Once the results are viewed in FIG. 5, to modify the different values used, the engineer is required to return to the graphical user interface of FIG. 3, redefine each field as desired, select the compute button in the interface of FIG. 4, and reevaluate the results using the interface of FIG. 5. Further, he user must recall the values desired (as displayed in FIG. 5) and manually input such values into FIG. 3 (copy and paste commands are not available). Such entry must be repeated for each profile desired while attempting to recall from memory the desired settings for each river station and each profile. This process is repeated numerous times until the desired results are achieved. Further, in FIG. 5, the previously defined floodplain encroachment values/results cannot be and are not displayed. In other words, if the user forgets the values previously used (or forgets to manually store them), a set of computations may be repeated unnecessarily.

Once the final desired results are achieved, since HEC-RAS is not integrated with any GIS system, the user must export the results from HEC-RAS back to the GIS system and may need to further manipulate the data for compatibility purposes.

In view of the above, one can see that the user is required to manually enter data for analysis and many steps are required merely to start the analysis. The user is then required to switch back and forth between user interfaces and dialogs for analysis and manipulating data while also requiring the user to export and import data back and forth between GIS systems and HEC-RAS. Lastly, there is no mechanism to mark a computation as finished or unfinished. Such manual efforts significantly slows the floodplain encroachment analysis process and is very inefficient.

What is needed is a mechanism to integrate a GIS system with HEC-RAS, a system that allows the user to view prior values utilized in a floodplain encroachment analysis, and an easy-to-use interface for entering, modifying, and updating encroachment values.

SUMMARY OF THE INVENTION

Embodiments of the invention overcome the problems of the prior art by examining an entire river and allowing an engineer to quickly apply the necessary floodplain encroachments along the rivers as well as meeting the FEMA requirements.

A graphical user interface (GUI) shows the engineer, in real time, what affect a specified floodplain encroachment has on the river water surface profile. Such an interface allows the engineer to quickly try different alternative encroachments and develop a "best" solution in minimal time. The GUI utilizes the HEC-RAS engine to compute the data analysis in a manner that is transparent to the user. Further, the workflow is simplified, making most data analysis automatic thereby reducing the amount of time required by the user.

Data (e.g., floodplain, river flow, encroachment data, points of flow, etc.) may be collected at a single point (e.g., a single dialog). Once collected, an analysis can be completed and marked according to however the user elects. Unlike the prior art, the exportation and importation of the data into a GIS system is not necessary or needed and the prior art trial and error methodology that is prone to error is avoided.

BRIEF DESCRIPTION OF THE DRAWINGS

Referring now to the drawings in which like reference numbers represent corresponding parts throughout:

FIG. 3 illustrates a dialog window used to define floodplain encroachment station locations for a single profile in the prior art;

FIG. 5 is a graphical user interface used to display results for the user to review in the prior art;

FIG. 8 is an example of an instantiated/populated encroachment grid of FIG. 7 provided in accordance with one or more embodiments of the invention;

DETAILED DESCRIPTION OF THE PREFERRED EMBODIMENTS

In the following description, reference is made to the accompanying drawings which form a part hereof, and which is shown, by way of illustration, several embodiments of the present invention. It is understood that other embodiments may be utilized and structural changes may be made without departing from the scope of the present invention.

Overview

One or more embodiments of the invention allow an engineer to quickly complete a FEMA floodplain encroachment study when compared to all prior art methods. The workflow greatly simplifies the prior art process that is manual, disjointed, and comprised of several different interfaces. Further, embodiments of the invention provide the ability to compute and view floodplain encroachment data in a single location/interface.

Hardware Environment

Figure 6:
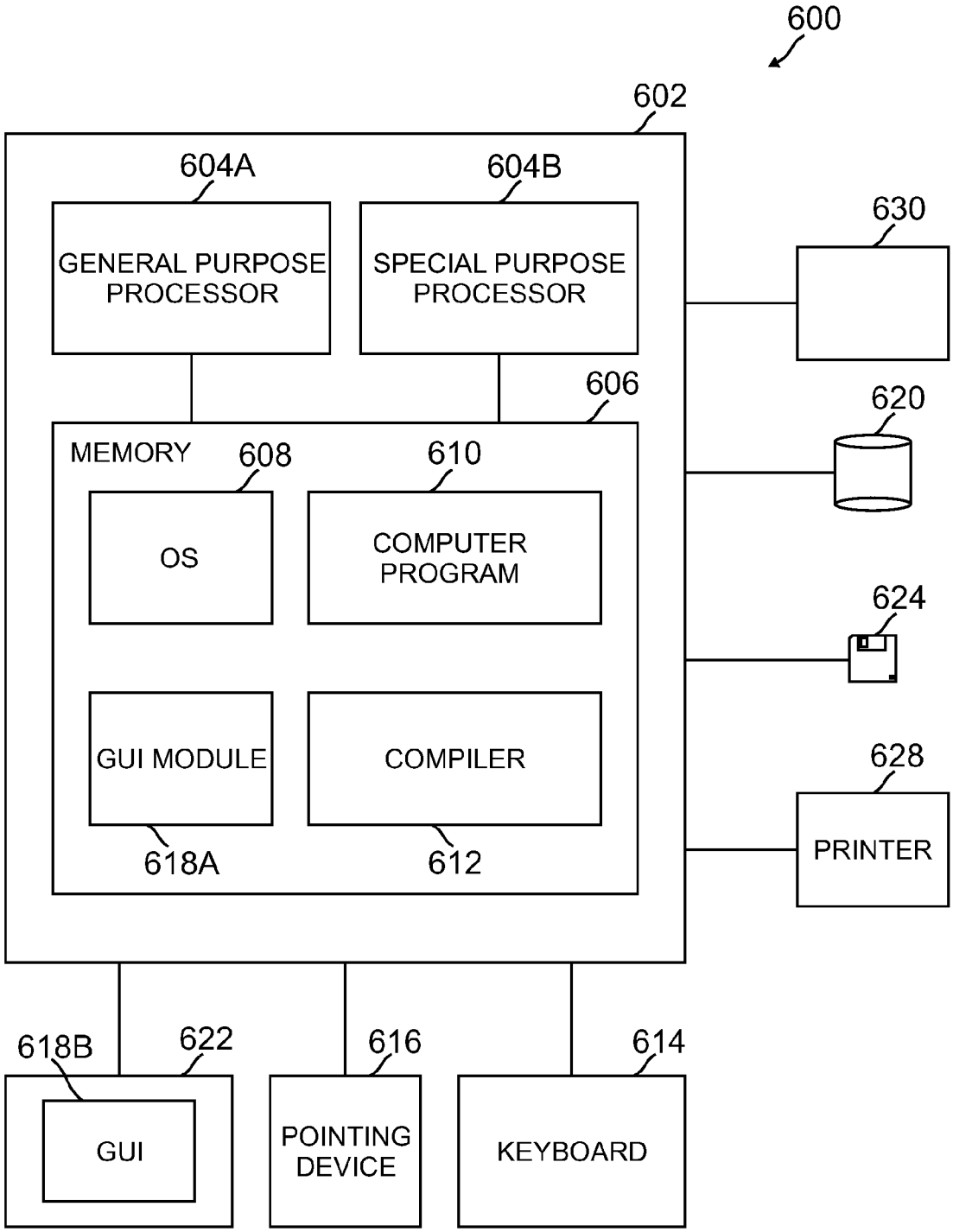
FIG. 6 is an exemplary hardware and software environment used to implement one or more embodiments of the invention.

FIG. 6 is an exemplary hardware and software environment 600 used to implement one or more embodiments of the invention. The hardware and software environment includes a computer 602 and may include peripherals. Computer 602 may be a user/client computer, server computer, or may be a database computer. The computer 602 comprises a general purpose hardware processor 604A and/or a special purpose hardware processor 604B (hereinafter alternatively collectively referred to as processor 604) and a memory 606, such as random access memory (RAM). The computer 602 may be coupled to other devices, including input/output (I/O) devices such as a keyboard 614, a cursor control device 616 (e.g., a mouse, a pointing device, pen and tablet, etc.) and a printer 628.

In one embodiment, the computer 602 operates by the general purpose processor 604A performing instructions defined by the computer program 610 under control of an operating system 608. The computer program 610 and/or the operating system 608 may be stored in the memory 606 and may interface with the user and/or other devices to accept input and commands and, based on such input and commands and the instructions defined by the computer program 610 and operating system 608 to provide output and results.

Output/results may be presented on the display 622 or provided to another device for presentation or further processing or action. In one embodiment, the display 622 comprises a liquid crystal display (LCD) having a plurality of separately addressable liquid crystals. Each liquid crystal of the display 622 changes to an opaque or translucent state to form a part of the image on the display in response to the data or information generated by the processor 604 from the application of the instructions of the computer program 610 and/or operating system 608 to the input and commands. The image may be provided through a graphical user interface (GUI) module 618A. Although the GUI module 618A is depicted as a separate module, the instructions performing the GUI functions can be resident or distributed in the operating system 608, the computer program 610, or implemented with special purpose memory and processors.

Some or all of the operations performed by the computer 602 according to the computer program 610 instructions may be implemented in a special purpose processor 604B. In this embodiment, the some or all of the computer program 610 instructions may be implemented via firmware instructions stored in a read only memory (ROM), a programmable read only memory (PROM) or flash memory within the special purpose processor 604B or in memory 606. The special purpose processor 604B may also be hardwired through circuit design to perform some or all of the operations to implement the present invention. Further, the special purpose processor 604B may be a hybrid processor, which includes dedicated circuitry for performing a subset of functions, and other circuits for performing more general functions such as responding to computer program instructions. In one embodiment, the special purpose processor is an application specific integrated circuit (ASIC).

The computer 602 may also implement a compiler 612 which allows an application program 610 written in a programming language such as COBOL, Pascal, C++, FORTRAN, or other language to be translated into processor 604 readable code. After completion, the application or computer program 610 accesses and manipulates data accepted from I/O devices and stored in the memory 606 of the computer 602 using the relationships and logic that was generated using the compiler 612.

The computer 602 also optionally comprises an external communication device such as a modem, satellite link, Ethernet card, or other device for accepting input from and providing output to other computers.

In one embodiment, instructions implementing the operating system 608, the computer program 610, and the compiler 612 are tangibly embodied in a computer-readable medium, e.g., data storage device 620, which could include one or more fixed or removable data storage devices, such as a zip drive, floppy disc drive 624, hard drive, CD-ROM drive, tape drive, etc. Further, the operating system 608 and the computer program 610 are comprised of computer program instructions which, when accessed, read and executed by the computer 602, causes the computer 602 to perform the steps necessary to implement and/or use the present invention or to load the program of instructions into a memory, thus creating a special purpose data structure causing the computer to operate as a specially programmed computer executing the method steps described herein. Computer program 610 and/or operating instructions may also be tangibly embodied in memory 606 and/or data communication devices 630, thereby making a computer program product or article of manufacture according to the invention. As such, the terms "article of manufacture," "program storage device" and "computer program product" as used herein are intended to encompass a computer program accessible from any computer readable device or media.

Of course, those skilled in the art will recognize that any combination of the above components, or any number of different components, peripherals, and other devices, may be used with the computer 602.

Software Embodiments

Computer program 610 is configured to automate the process by which a water resource engineer would need to compute FEMA floodplain encroachment stationing along a river. Embodiments of the invention examine the entire river, and allow the engineer to quickly apply the necessary floodplain encroachments along the river as well as meet the FEMA requirements. The program 610 shows the engineer, in real time, what affect a specified floodplain encroachment has on the river water surface profile. Such a display allows the engineer to quickly try different alternative encroachments and come up with a "best" solution in minimal time. In this regard, embodiments of the invention can reduce the amount of time to $1/10^{th}$ of the prior art time requirements.

The computer program 610 utilizes/interfaces with HEC-RAS, but simplifies the workflow, automating a majority of the data analysis, and reducing the amount of time required by the user. Various pieces of data are collected (e.g., using a dialog box) to determine the floodplain, the river flow, encroachment data, points of flow, etc. Once the data is collected, an analysis is completed and marked according to how the user desires to utilize the data. Unlike the prior art, imports and exports of the data are not required and a solution is not computed through a complex trial and error process.

Figure 7:
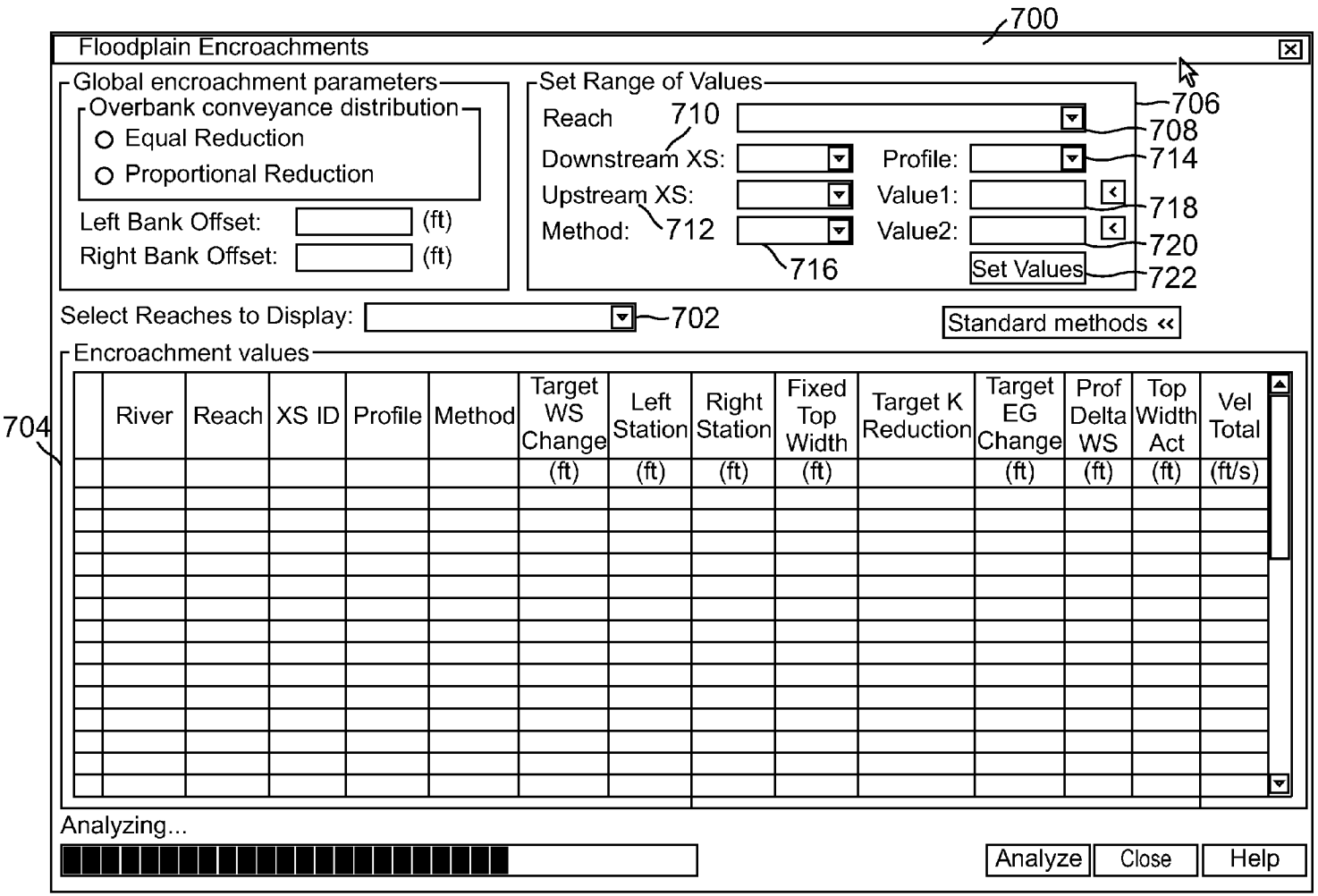
FIG. 7 is a user interface dialog box used to compute floodplain encroachments in accordance with one or more embodiments of the invention.

FIG. 7 is a user interface dialog box used to compute floodplain encroachments in accordance with one or more embodiments of the invention. All engineering work may be performed from the user interface dialog box 700. Note that while the fields in dialog box 700 may include dropdown selection boxes, radio buttons, or text fields, any type of GUI element may be used to receive input from a user. Further, the various fields may have pre-defined selections and/or default values that are presented to the user. The user may first select (in field 702) the river and particular reach of the river for which the user desires to define the encroachment. Once selected, only the selected reaches will be displayed in grid area 704.

Once selected in field 702, the user can opt to set the values for the selected reach using area 706. In this regard, once selected, the reach may be displayed in area 708. In field 710, the list of cross sections for the selected reach can be selected. In field 712, the list of all cross sections upstream to the selected downstream cross-section can be selected. In profile area 714, a list of all defined profiles (except for the base 100 year flood profile—profile 1) will be available. The list of methods is selectable in area 716. As described above, in FEMA, one of two methods are the preferred methods to use for defining encroachments—method 4 and method 1.

Method 4 allows the user to specify where the user believes the specified encroachment stations should be. Method 1 provides the ability to map over and finalize the station settings. Based on the selected method in field 716, the values will be presented in field 718 and 720. The caption and unit in field 718-720 may change dynamically based on the selected method. Depending on the method selected, value 2 720 control may be disabled. Once the user has specified the desired values in fields 706-720, button 722 can be selected to set the values of the selected range into encroachment grid 704.

FIG. 8 is an example of an instantiated encroachment grid 704 of FIG. 7 provided in accordance with one or more embodiments of the invention. As previously noted, the areas of import are the change in surface elevation 802 (i.e., the delta water surface elevation), the top width 804, and the velocity 806. The reach of the river specified is displayed in column 808. Each cross section being examined is displayed in column 810 based on a cross section identification (ID). For each cross section identified in column 810, each of the configured profiles is listed in a separate row of column 812. FEMA requires the base profile (for comparison) and at least two additional profiles in order to define/compute the encroachment values. The user may use a different dialog box to configure a profile where the downstream flow and slope (i.e., downstream condition) may be defined.

Once profiles have been configured and are displayed in grid 704, the user identifies the method to be used for each profile in column 814. As can be seen, methods are not selectable for the base profile 1 (since profile 1 is used for comparison purposes to the other profiles). The different options from the drop down list for the methods are "None", "Method 4", "Method 1", and "Copy 4 to 1". The "Copy 4 to 1" option is only available if the current method is method 4 and there are analysis results available. Selection of "Copy 4 to 1" presents a confirmation dialog that performs the operation and changes then changes the corresponding option in column 814 to "Method 1". Such a copying maps over the desired values and confirms the defined encroachment values that are defined by the user. Alternatively, rather than specifying each method from within grid 704, the user can simply specify the method and profile in areas 714 and 716 of FIG. 7 and set the values within the grid using the set values button 722.

Once the methods have been specified, for each method, the user can input the target water surface elevation rise/change in column 816. Such values can be sent manually per cell or can be set across multiple profiles/methods using fields 718 and 720 of FIG. 7. In addition, as part of the user input process, the user can manually enter potential values for the left and right encroachment stations in columns 820-822.

Once entered, the user can select the "Analyze" button 818 that executes the HEC-RAS analysis with the specified encroachment definitions/input data. In other words, the HEC-RAS engine processes the station, profile, method, etc. based on the user-specified data. Computing the appropriate encroachment values to match the user input target value is computationally difficult. Such difficulty arises because a change at one cross section may significantly alter the rise/surface elevation at another cross section. Accordingly, the HEC-RAS engine has limited capabilities and attempts to change the left/right encroachment stations to meet the target value a non-user specified pre-defined number of times (e.g., 4 times, 20 times, etc.) before concluding. After the execution has completed, the analysis results are loaded and displayed in columns 802-806 (which may be displayed with a different fill color such as yellow highlighting). If the results are not what is desired, the user must specify a different target value is column 816 and press the analyze button 818 again.

As an example, the actual change displayed in column 402 may be exactly one foot (and may match the target value specified in column 816). However, the top width and velocity values with such a change may not be compatible with FEMA regulations/guidelines. Accordingly, the user may need to update the target values to arrive at desirable analysis results for each of the fields in columns 802-806.

Using the GUIs of FIGS. 7 and 8, the user can view the results of any adjustments to the encroachment definitions specified in columns 815-822. Such results are displayed dynamically (in real-time after the analyze button 818 is selected) in a single graphical user interface 700. Further, rather than requiring the user to move to a separate dialog box and recall from memory what values were used in the HEC-RAS analysis, the graphical user interface of FIGS. 7 and 8 displays the values specified for the user to see simultaneously with the results. Accordingly, no manual memory recall is required. Further, the user can see the total width gained by the encroachment definitions specified.

As an example, the top row of table 704 in FIG. 8 displays the original floodchannel width of 1862.61 feet. The encroachment definitions have provided the ability to increase the water surface elevation at station 5.76 by less than one foot (i.e., 0.98 ft) as can be seen in rows 2-4 of column 802. Further, the top width has been decreased to 1024.90 feet providing a gain of over 800 feet of developable encroachments based on the encroachment definitions specified.

Figure 1:
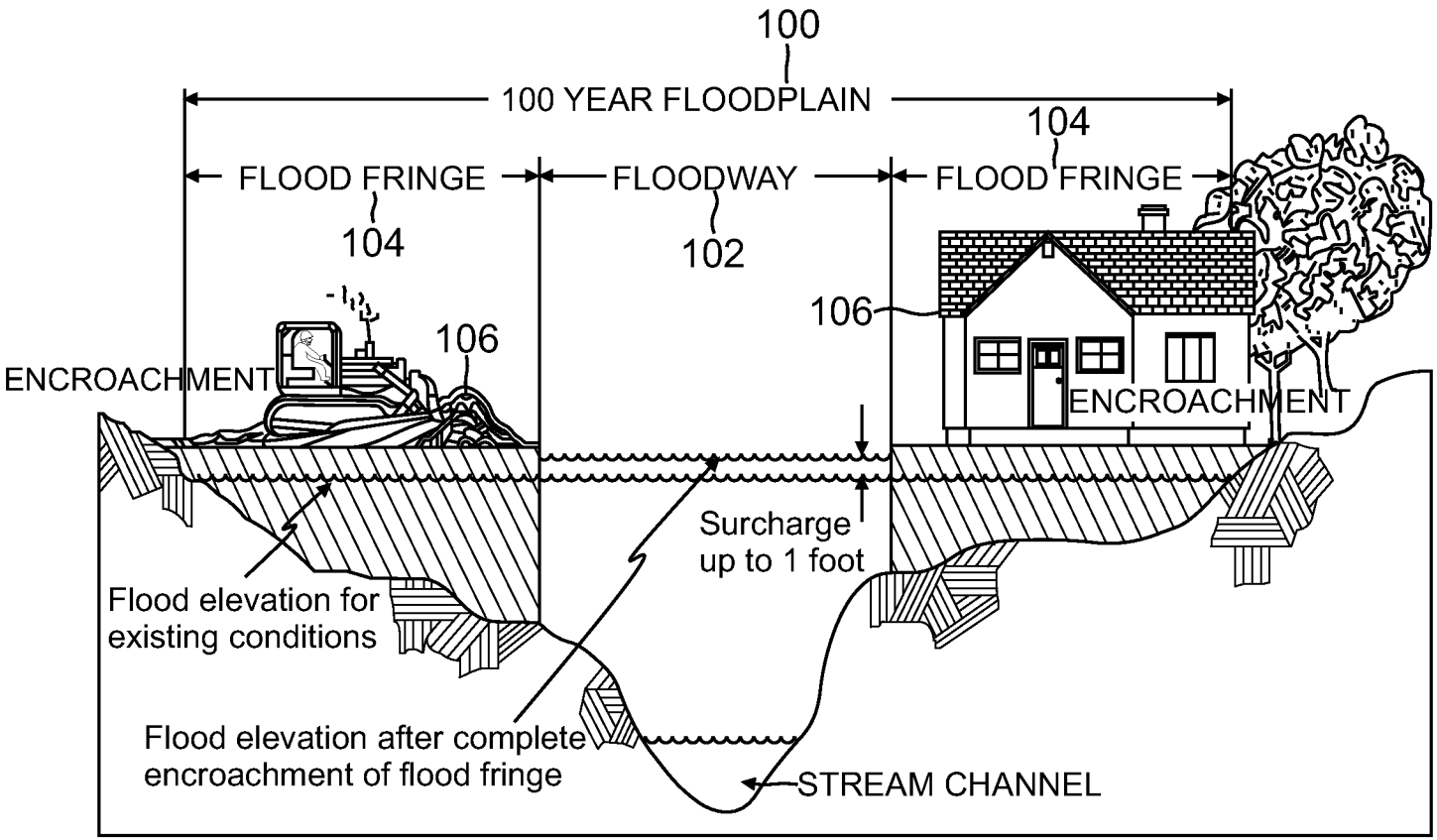
FIG. 1, is a diagram of a floodplain in accordance with the prior art.
Figure 2:
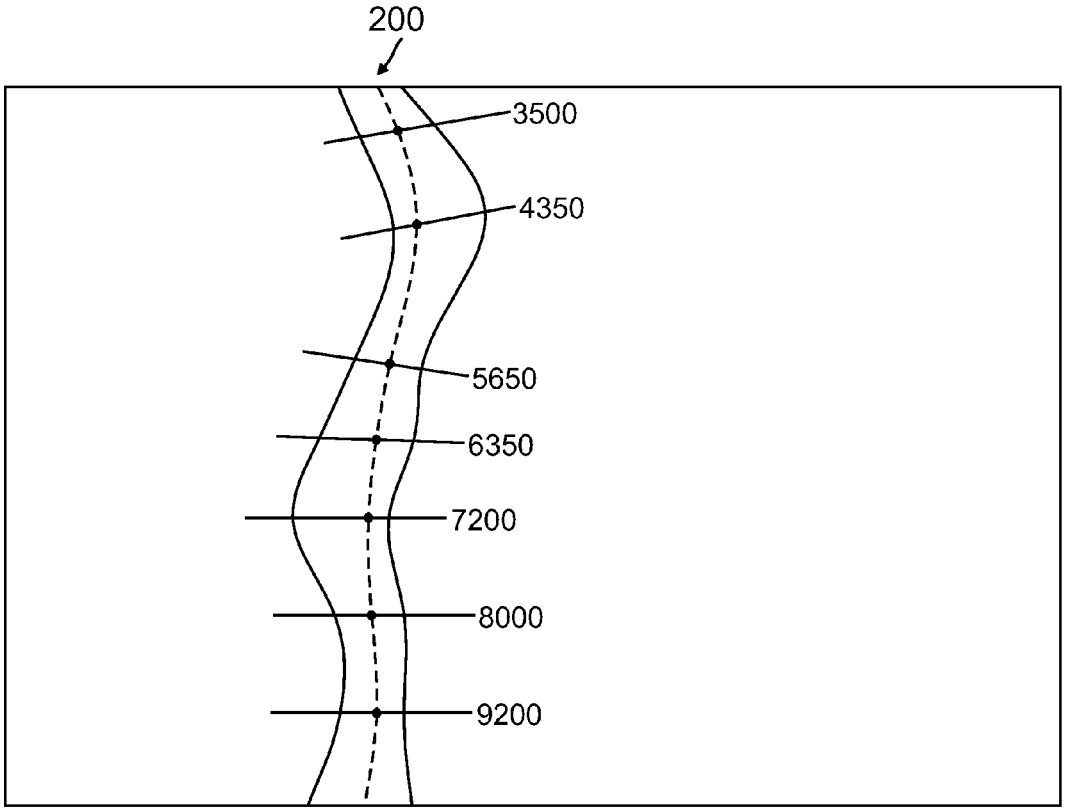
FIG. 2 (PRIOR ART)
FIG. 2 is a mock up display of a river having various cross sections in accordance with the prior art.
Figure 4:
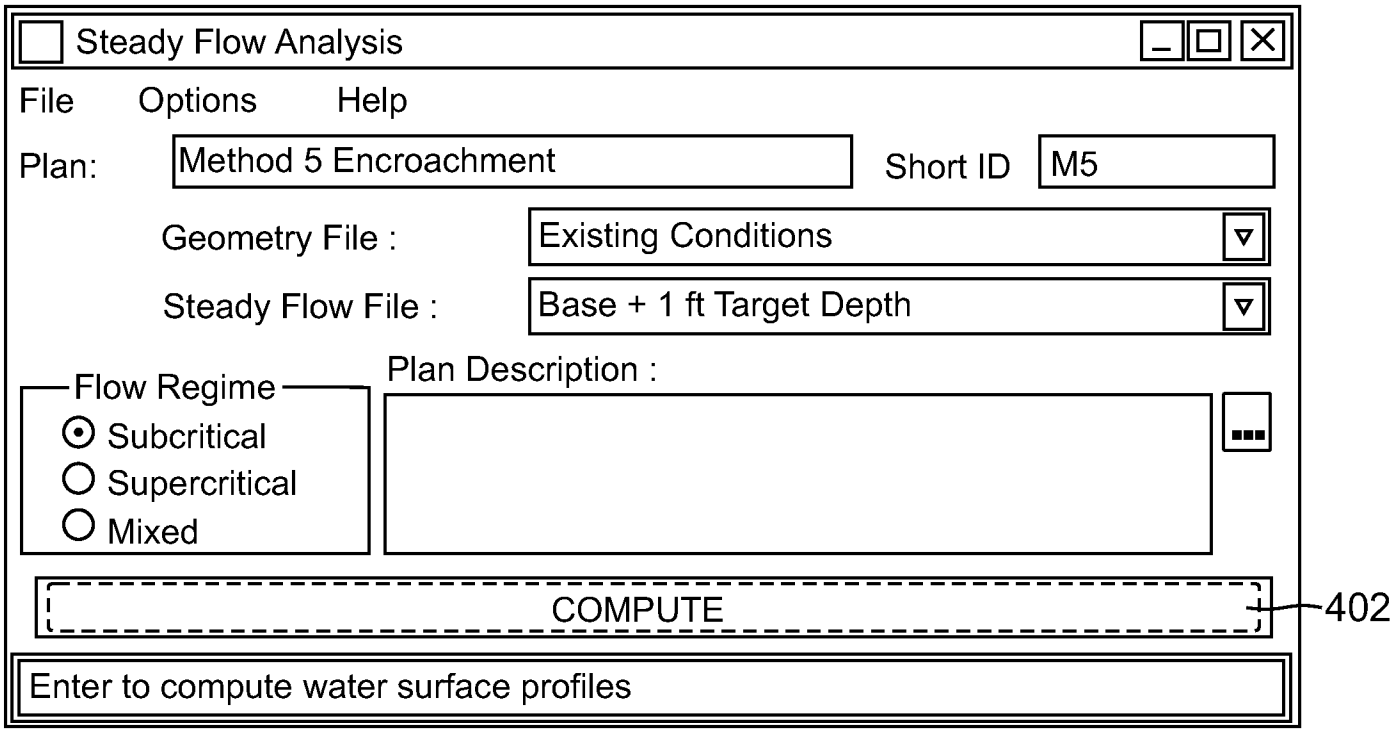
FIG. 4 (PRIOR ART)
FIG. 4 is the graphical user interface used to perform a computational analysis in the prior art.
Figure 9:
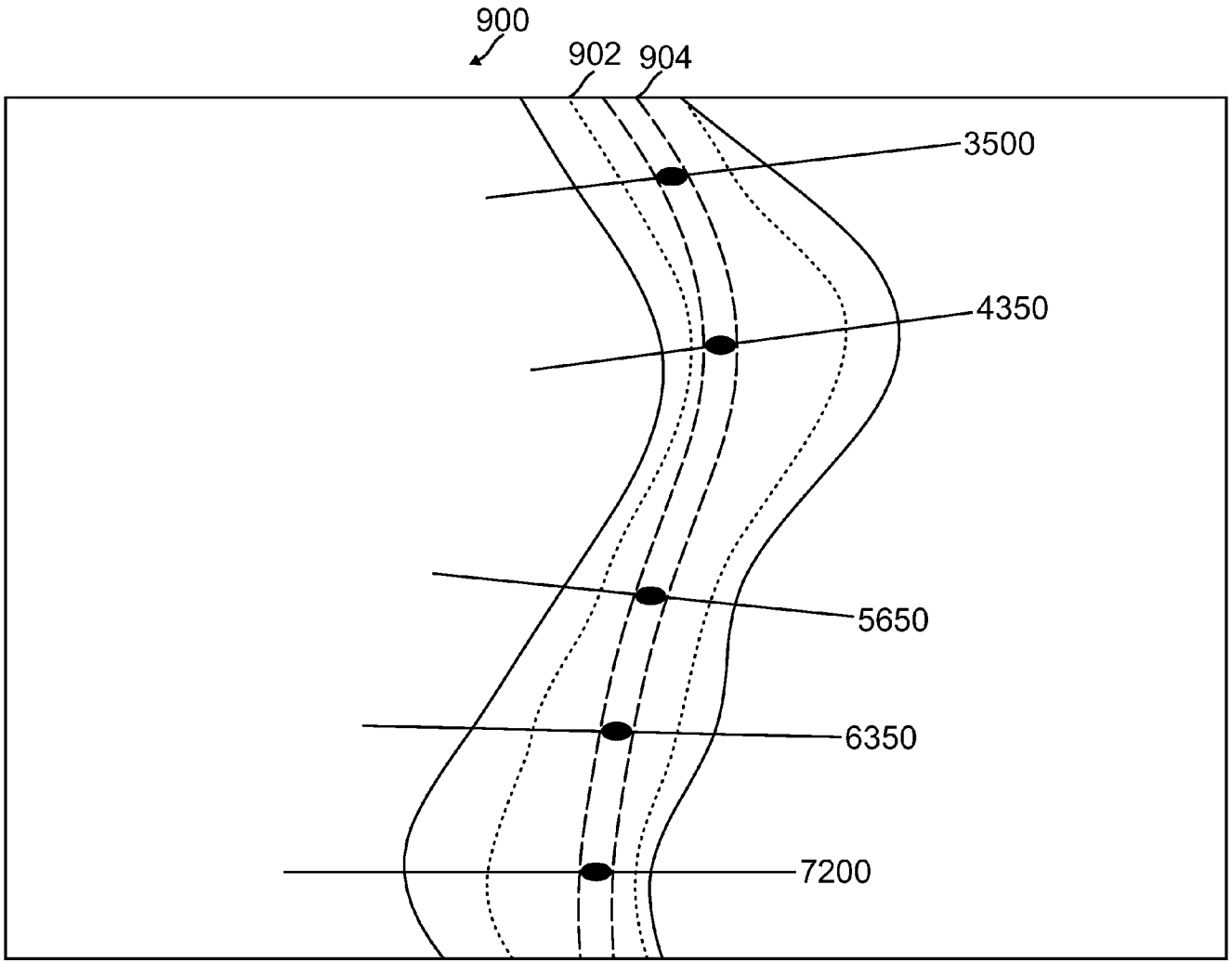
FIG. 9 illustrates a magnified view of a floodplain map that illustrates a change in top width created in accordance with one or more embodiments of the invention.

Once the encroachment definitions and analysis results are satisfactory to the engineer, a map similar to that illustrated in FIG. 2 can be created that not only illustrates the old floodway using the base flood but also illustrating the new floodway with the specified encroachments. FIG. 9 illustrates a magnified view of a floodplain map that illustrates a change in top width created in accordance with one or more embodiments of the invention. In FIG. 9, the old floodway is delineated by the fine dotted lines 902. The new floodway is now a smaller channel delineated by the dashed lines 904. As illustrated, the user has gained substantial land in the floodplain fringe for developing. A map similar to that of map 900 of FIG. 9 can be turned into FEMA as part of the support documentation to obtain approval for floodplain encroachment developments.

Logical Flow

Figure 10:
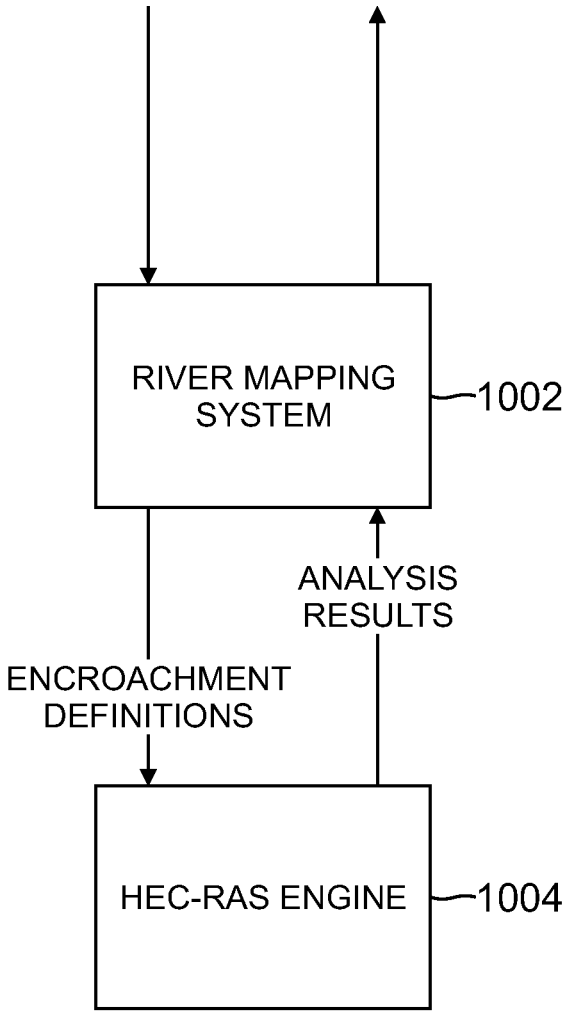
FIG. 10 illustrates the components of a system used to define floodplain encroachments in accordance with one or more embodiments of the invention.

FIG. 10 illustrates the components of a system used to define floodplain encroachments in accordance with one or more embodiments of the invention. FIG. 10 illustrates river mapping system 1002 and HEC-RAS engine 1004 that are used to define the encroachments. While illustrated as two separate applications in FIG. 10, both the river mapping system 1002 and HEC-RAS engine 1004 may be a single application/computer program or multiple computer programs. Computer program 610 of FIG. 6 is used to represent one or more such applications.

As described above, the river mapping system 1002 can be used to define, display, and manipulate water ways such as rivers, streams, etc. Such a system 1002 may be used to provide geospatial data and to modernize the paper-based maps currently used by FEMA. A user enters, into the river mapping system 1002, the various river stations and settings from studies performed on the riverway. Once the river stations/cross sections are entered into the system, the user utilizes the graphical user interfaces of FIG. 7 and FIG. 8 to input encroachment definitions (i.e., potential target water surface elevation changes/rise and/or potential left/right station measurements).

The river mapping system 1002 interfaces with the HEC-RAS engine 1004 (which is written in FORTRAN™) and provides the encroachment definitions via an application programming interface (API) of the HEC-RAS engine. The HEC-RAS engine 1004 performs the analysis based on the encroachment definitions and responds with the analysis results to the river mapping system 1002. To perform the analysis, the HEC-RAS engine 1004 may receive a geometry import file (in accordance with a particular format) that defines the river (also known as the stream network) (that includes the various reaches), the cross-sections of the stream network, one or more levees, ineffective areas of the stream network, and storage areas including elevation volumes and terrain specifications. The river mapping system 1002 may create such an import file in order to utilize the HEC-RAS engine 1004. After performing the analysis, the HEC-RAS engine 1004 exports a file (in a predefined format) that contains the analysis results.

The river mapping system 1002 displays the analysis results simultaneously with the previously submitted encroachment definitions to the user. This process is repeated various times until the user is satisfied with the analysis results and the encroachment definitions. The API and interaction with HEC-RAS 1004 is performed in the background without transparently to the user. In other words, the user is unaware of the existence or use of HEC-RAS engine 1004 to perform the analysis.

Figure 11:
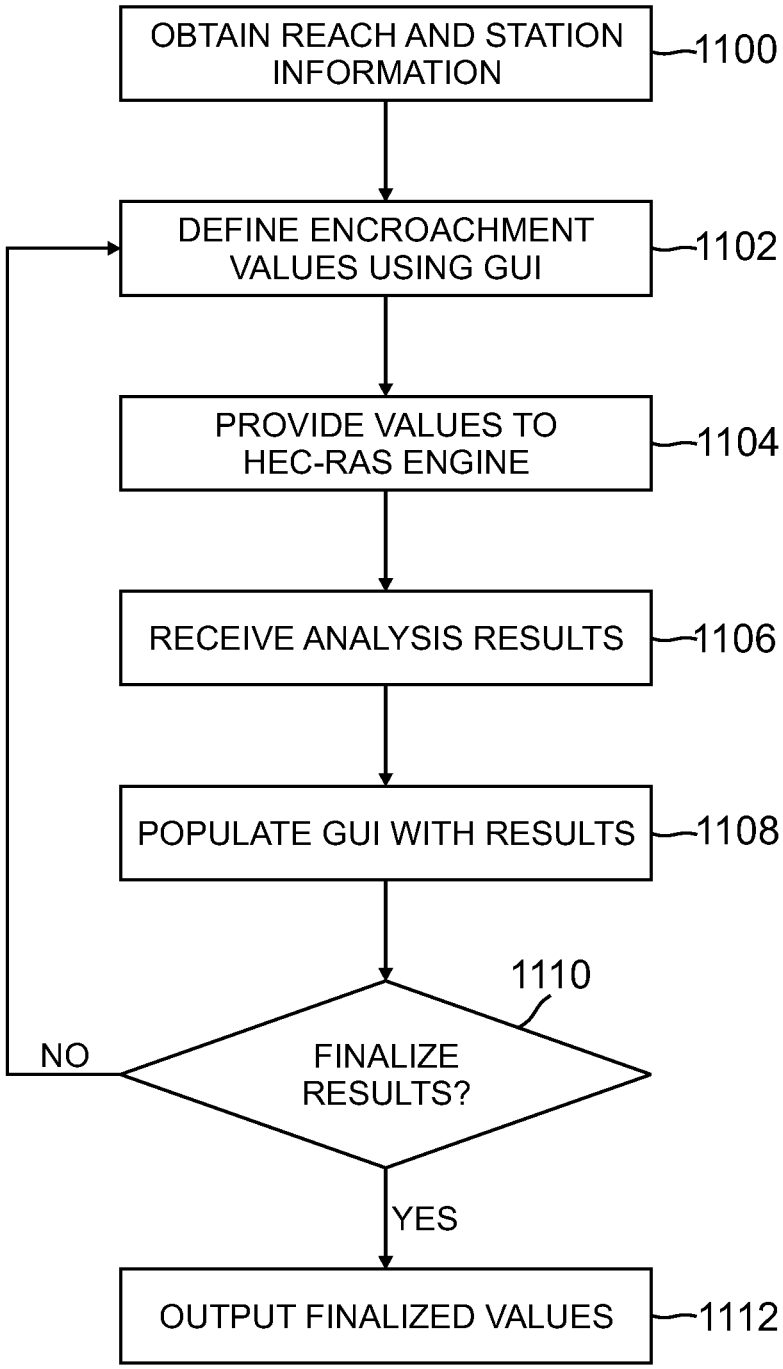
FIG. 11 is a flow chart illustrating the logical flow for defining encroachments in accordance with one or more embodiments of the invention.

FIG. 11 is a flow chart illustrating the logical flow for defining encroachments in accordance with one or more embodiments of the invention. At step 1100, river reach and station information is obtained/received into a geographic information system (GIS).

At step 1102, floodplain encroachment values are defined using a flood plain encroachment GUI of the GIS. The floodplain GUI includes a simultaneous view of multiple fields including:

(a) station identifiers for each station for which the floodplain encroachment is to be defined;

(b) one or more profiles defined for each of the station identifiers;

(c) a method identification corresponding to each of the profiles (except for a base profile) where the method identification identifies the method used to analyze the corresponding profile to compute a base flood elevation; and (d) a target water surface elevation change for each profile that is input (e.g., by a user) into the GIS.

To define the values in the GUI, the user can specify values for individual settings or may simultaneously set a range of values using a dialog box within the GUI. Such a dialog box can provide fields for the user to specify values to be used across multiple cross sections, profiles, methods, etc.

At step 1104, the floodplain encroachment values are provided to the HEC-RAS engine.

At step 1106, the analysis results are received from the HEC-RAS engine.

At step 1108, the GUI is populated with the analysis results by displaying the above described fields simultaneously with the analysis results. The analysis results include:

(e) for each of the profiles, a water surface elevation change as calculated by the HEC-RAS engine;

(f) for each of the profiles, a top width of a floodway as calculated by the HEC-RAS engine; and (g) for each of the profiles, a water velocity as calculated by the HEC-RAS engine.

In one or more embodiments, one or more of the steps 1104-1108 are performed transparently to the user. In other words, the use of the HEC-RAS engine is transparent to the user as the user merely views the defined values and the analysis results in the same GUI. Multiple screens and dialog boxes are not used or needed.

The GUI may be displayed in any acceptable manner or format. In one or more embodiments, the GUI is a grid having a row for each of the station identifier-defined profile pairs, wherein each row displays corresponding analysis results.

At step 1110, a determination is made regarding whether the results have been finalized. If they are not finalized, the floodplain encroachment values can be modified (e.g., by a user) at step 1102, and the process repeats. To finalize the results, the user can simply copy the values from method 4 to method 1 (as illustrated in FIG. 8 above). Alternatively, the finalization may simply utilize the last used values that were defined by the user and/or analyzed by the underlying HEC-RAS engine.

Once the results have been finalized (e.g., the user is satisfied with the results), the finalized values are output at step 1112. Such an output may display/print the results on a map. For example, newly calculated left and right encroachment stations may be plot on a river map that simultaneously to illustrate both the old and newly calculated floodway. Alternatively, the data may simply be transmitted to an entity/program utilized by FEMA or others for approving encroachment developments.

Conclusion

This concludes the description of the preferred embodiment of the invention. The following describes some alternative embodiments for accomplishing the present invention. For example, any type of computer, such as a mainframe, minicomputer, or personal computer, or computer configuration, such as a timesharing mainframe, local area network, or standalone personal computer, could be used with the present invention. Further, any type of thin client/mobile device such as a cellular telephone, satellite phone, personal digital assistant, computer/tablet-based computer, or portable/mobile-computing device (e.g., IPOD™, IPOD™ TOUCH™, etc.) could be used with the present invention.

The foregoing description of the preferred embodiment of the invention has been presented for the purposes of illustration and description. It is not intended to be exhaustive or to limit the invention to the precise form disclosed. Many modifications and variations are possible in light of the above teaching. It is intended that the scope of the invention be limited not by this detailed description, but rather by the claims appended hereto.

What is claimed is:

1. A computer-implemented method for defining a floodplain encroachment, comprising:

(a) obtaining river reach and station information into a geographic information system (GIS);

(b) defining floodplain encroachment values using a floodplain encroachment graphical user interface (GUI) of the GIS, wherein the floodplain GUI comprises a simultaneous view of:

(i) station identifiers for each station for which the floodplain encroachment is to be defined;

(ii) one or more profiles defined for each of the station identifiers, wherein the one or more profiles comprise discharge profiles that specify an amount of water that passes a point in a given time period;

(iii) a method identification corresponding to each of the one or more profiles except for a base profile, wherein the method identification identifies the method used to analyze the corresponding profile to compute a base flood elevation;

(iv) a target water surface elevation change for each profile that is input into the GIS;

(c) providing the floodplain encroachment values to a Hydrologic Engineering Centers River Analysis System (HEC-RAS) engine;

(d) receiving analysis results from the HEC-RAS engine and further populating the floodplain GUI with the analysis results by displaying items (b)(i)-(iv) simultaneously with:

(v) for each of the one or more profiles, a water surface elevation change as calculated by the HEC-RAS engine;

(vi) for each of the one or more profiles, a top width of a floodway as calculated by the HEC-RAS engine;

(vii) for each of the one or more profiles, a water velocity as calculated by the HEC-RAS engine;

(e) modifying the floodplain encroachment values that are used by HEC-RAS and repeating steps (c)-(e) until the floodplain encroachment values are finalized;

(f) finalizing the floodplain encroachment values; and (g) outputting the finalized floodplain encroachment values.

2. The method of claim 1, wherein the floodplain encroachment GUI comprises a grid having a row for each of one or more station identifier-defined profile pairs, wherein each row displays corresponding analysis results.

3. The method of claim 1, further comprising simultaneously defining a range of values for the floodplain encroachment values using a dialog box within the floodplain encroachment GUI.

4. The method of claim 1, wherein the floodplain encroachment values are provided to the HEC-RAS engine, analysis results are received from the HEC-RAS engine, and the floodplain GUI is populated with the analysis results, transparently to a user.

5. The method of claim 1, wherein the floodplain encroachment values are finalized by copying encroachment values from one method to a second method.

6. The method of claim 1, wherein the finalized floodplain encroachment values are output by plotting new left and right encroachment stations on a river map.

7. An apparatus for defining a floodplain encroachment in a computer system comprising:

(a) a computer having a memory and a processor;

(b) an application executing on the processor, wherein the application is configured to:

(i) obtaining river reach and station information into a geographic information system (GIS);

(ii) defining floodplain encroachment values using a floodplain encroachment graphical user interface (GUI) of the GIS, wherein the floodplain GUI comprises a simultaneous view of:

(1) station identifiers for each station for which the floodplain encroachment is to be defined;

(2) one or more profiles defined for each of the station identifiers, wherein the one or more profiles comprise discharge profiles that specify an amount of water that passes a point in a given time period;

(3) a method identification corresponding to each of the one or more profiles except for a base profile, wherein the method identification identifies the method used to analyze the corresponding profile to compute a base flood elevation;

(4) a target water surface elevation change for each profile that is input into the GIS;

(iii) providing the floodplain encroachment values to a Hydrologic Engineering Centers River Analysis System (HEC-RAS) engine;

(iv) receiving analysis results from the HEC-RAS engine and further populating the floodplain GUI with the analysis results by displaying items (b)(ii)(1)-(4) simultaneously with:

(5) for each of the one or more profiles, a water surface elevation change as calculated by the HEC-RAS engine;

(6) for each of the one or more profiles, a top width of a floodway as calculated by the HEC-RAS engine;

(7) for each of the one or more profiles, a water velocity as calculated by the HEC-RAS engine;

(v) modifying the floodplain encroachment values that are used by HEC-RAS and repeating steps (c)-(e) until the floodplain encroachment values are finalized;

(vi) finalizing the floodplain encroachment values; and (vii) outputting the finalized floodplain encroachment values.

8. The apparatus of claim 7, wherein the floodplain encroachment GUI comprises a grid having a row for each of one or more station identifier-defined profile pairs, wherein each row displays corresponding analysis results.

9. The apparatus of claim 7, wherein the application is further configured to simultaneously define a range of values for the floodplain encroachment values using a dialog box within the floodplain encroachment GUI.

10. The apparatus of claim 7, wherein the floodplain encroachment values are provided to the HEC-RAS engine, analysis results are received from the HEC-RAS engine, and the floodplain GUI is populated with the analysis results, transparently to a user.

11. The apparatus of claim 7, wherein the floodplain encroachment values are finalized by copying encroachment values from one method to a second method.

12. The apparatus of claim 7, wherein the finalized floodplain encroachment values are output by plotting new left and right encroachment stations on a river map.

13. A computer readable storage medium encoded with computer program instructions which when accessed by a computer cause the computer to load the program instructions to a memory therein creating a special purpose data structure causing the computer to operate as a specially programmed computer, executing a method of defining a floodplain encroachment, comprising:

(a) obtaining, in the specially programmed computer, river reach and station information into a geographic information system (GIS);

(b) defining, in the specially programmed computer, floodplain encroachment values using a floodplain encroachment graphical user interface (GUI) of the GIS, wherein the floodplain GUI comprises a simultaneous view of:

(i) station identifiers for each station for which the floodplain encroachment is to be defined;

(ii) one or more profiles defined for each of the station identifiers, wherein the one or more profiles comprise discharge profiles that specify an amount of water that passes a point in a given time period;

(iii) a method identification corresponding to each of the one or more profiles except for a base profile, wherein the method identification identifies the method used to analyze the corresponding profile to compute a base flood elevation;

(iv) a target water surface elevation change for each profile that is input into the GIS;

(c) providing, in the specially programmed computer, the floodplain encroachment values to a Hydrologic Engineering Centers River Analysis System (HEC-RAS) engine;

(d) receiving, in the specially programmed computer, analysis results from the HEC-RAS engine and further populating the floodplain GUI with the analysis results by displaying items (b)(i)-(iv) simultaneously with:

(v) for each of the one or more profiles, a water surface elevation change as calculated by the HEC-RAS engine;

(vi) for each of the one or more profiles, a top width of a floodway as calculated by the HEC-RAS engine;

(vii) for each of the one or more profiles, a water velocity as calculated by the HEC-RAS engine;

(e) modifying, in the specially programmed computer, the floodplain encroachment values that are used by HEC-RAS and repeating steps (c)-(e) until the floodplain encroachment values are finalized;

(f) finalizing, in the specially programmed computer, the floodplain encroachment values; and (g) outputting, in the specially programmed computer, the finalized floodplain encroachment values.

14. The computer readable storage medium of claim 13, wherein the floodplain encroachment GUI comprises a grid having a row for each of one or more station identifier-defined profile pairs, wherein each row displays corresponding analysis results.

15. The computer readable storage medium of claim 13, further comprising simultaneously defining a range of values for the floodplain encroachment values using a dialog box within the floodplain encroachment GUI.

16. The computer readable storage medium of claim 13, wherein the floodplain encroachment values are provided to the HEC-RAS engine, analysis results are received from the HEC-RAS engine, and the floodplain GUI is populated with the analysis results, transparently to a user.

17. The computer readable storage medium of claim 13, wherein the floodplain encroachment values are finalized by copying encroachment values from one method to a second method.

18. The computer readable storage medium of claim 13, wherein the finalized floodplain encroachment values are output by plotting new left and right encroachment stations on a river map.

* * * * *